United States Patent [19]

Moyer

[11] 4,026,101

[45] May 31, 1977

[54] PUSH BUTTON RESPONSE OF COMBINATION LCD/LED WRISTWATCH

[75] Inventor: Norman E. Moyer, Newport Beach, Calif.

[73] Assignee: Hughes Aircraft Company, Culver City, Calif.

[22] Filed: May 27, 1975

[21] Appl. No.: 581,179

[52] U.S. Cl. ..... 58/50 R; 58/4 A; 58/58

[51] Int. Cl.[2] ..... G04B 19/30

[58] Field of Search ..... 58/23 R, 4 R, 4 A, 50 R, 58/58 R, 127 R; 350/160 LC

[56] References Cited

UNITED STATES PATENTS

| | | | |
|---|---|---|---|
| 3,668,861 | 6/1972 | Mitsui | 58/50 R |
| 3,707,071 | 12/1972 | Walton | 58/50 R |
| 3,760,582 | 9/1973 | Thiess | 58/50 R |
| 3,765,163 | 10/1973 | Levine | 58/50 R |
| 3,768,247 | 10/1973 | Fujita | 58/23 R |
| 3,984,973 | 10/1976 | Ho | 58/50 R |

*Primary Examiner*—Robert K. Schaefer
*Assistant Examiner*—Vit W. Miska
*Attorney, Agent, or Firm*—F. I. Konzem; W. H. MacAllister

[57] ABSTRACT

A digital wristwatch with dual displays, one a liquid crystal display (LCD) for use in daylight or bright light and the other a light emitting diode (LED) display for use in dim light, is provided with three controlling push buttons (LED, Date and Set) for five display conditions and four setting conditions. With no button pressed, hours and minutes are displayed by the LCD elements. The LED button alone causes the LED elements to also display the hours and minutes for at least 1.5 seconds and the Date button alone causes the date to appear by the LCD, and if the Date push button is held over about 1.5 seconds the date will also appear on the LED display. The LED and Date buttons pressed together will cause the LCD elements to display the seconds, even after they have been released for "hands off" seconds display until either push button is again momentarily pressed. The Set button slews hours when pressed alone, and slews minutes and instantaneously zeros seconds when pressed together with LED, and slews the date when pressed together with the Date push button. Pressing all three will cause a complete reset of all counters.

6 Claims, 4 Drawing Figures

PUSH BUTTON RESPONSE OF COMBINATION LCD/LED WRISTWATCH

BACKGROUND OF THE INVENTION

1. FIELD OF THE INVENTION

This invention relates to digital electronic watches, and more particularly to push button control of display and setting of a digital wristwatch having both a liquid crystal display (LCD) and a light emitting diode (LED) display for displaying horological data.

2. DESCRIPTION OF THE PRIOR ART

In the art, LED displays have been employed as display elements for digital wristwatches, however, several drawbacks exist with this type of wristwatch. One drawback is that it is difficult to read the LED display in sunlight or in high intensity artificial light. Another drawback is that a large amount of power is required to operate the LED's. To conserve power, watches have been designed to display the horological data only when the user presses a push button.

Liquid crystal display (LCD) elements have also been used for digital electronic watches, as disclosed in application Ser. No. 515,797 filed Oct. 17, 1974, entitled "Digital Watch with Liquid Crystal Display" assigned to the assignee of the present application. LCD elements use less power but a problem with them is that no display is possible in total darkness and it is difficult to read the display in dim light.

SUMMARY OF THE INVENTION

In a digital electronic watch operating on miniature batteries and provided with (i) liquid crystal display (LCD) for selective display of horological data, (ii) light emitting diode (LED) display for display of selected horological data including date, hours, and minutes, and (iii) three spring biased push button, two for selecting the data to be displayed and controlling which display it will appear on, and one for controlling watch setting functions, a multiplex control unit is provided to respond to the state of the push buttons according to the following table:

| LED $B_1$ | Date $B_2$ | Set $B_3$ | LCD Response | LED Response |
|---|---|---|---|---|
| 0 | 0 | 0 | Hours - minutes | Off |
| 1 | 0 | 0 | Hours - minutes | Hr-min. |
| 0 | 1 | 0 | Date | Date |
| 1 | 1 | 0 | Seconds | Off |
| 0 | 0 | 0 | (From 110 state) seconds | Off |
| 0 | 0 | 1 | *Slew hours | Off |
| 1 | 0 | 1 | *Slew min., instantaneously zero sec. | Off |
| 0 | 1 | 1 | *Slew date | Off |
| 1 | 1 | 1 | *Master reset | Off |

*LCD response to $B_1$ and $B_2$ is not affected by $B_3$.

where a 1 indicates a button is pushed and 0 indicates not pushed.

LCD display of hours and minutes is continuous when no buttons are depressed. Hours and minutes data is also displayed on the LED positions when the button $B_1$ is depressed for about 1.5 seconds or until the button is released, whichever is longer. Depressing button $B_2$ causes the date to be displayed on the LCD, and, after about 1.5 seconds, to also appear on the LED display for as long as $B_2$ is depressed. Depressing both $B_1$ and $B_2$ simultaneously causes the seconds to be displayed on the LCD. A latching means retains this instruction for hands off display of seconds, until the latching means is reset by depressing either button $B_1$ or $B_2$. When button $B_3$ is depressed (for setting) with button $B_1$ or $B_2$ depressed, or with neither depressed, pertinent horological data appears on the LCD and the LED display is inhibited while clock pulses are gated into the units counter for the data being advanced under control of decoding means responsive to the buttons. When all three buttons are depressed, the decoding means causes a reset of all counters.

The features of the present invention which are believed to be novel are set forth with particularity in the appended claims. The present invention, both as to its organization and manner of operation, may be better understood from the following description with reference to the accompanying drawings.

A BRIEF DESCRIPTION OF THE DRAWINGS

DETAILED DESCRIPTIONN

Figure 1:
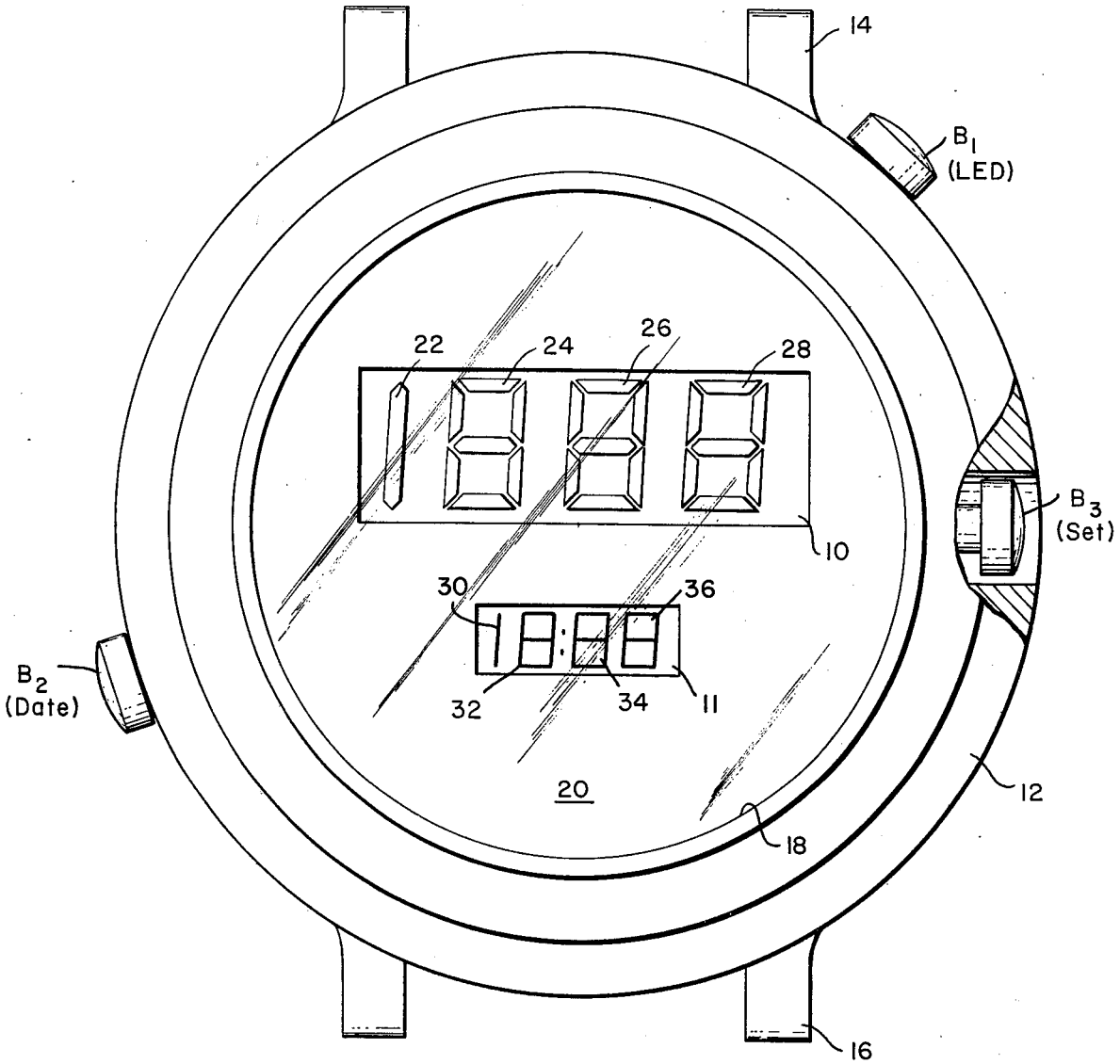
FIG. 1 is a top-plan view of a digital wristwatch with LCD and LED displays which selectively display horological information, in accordance with this invention.

Referring now to FIG. 1, a digital wristwatch is shown having LCD display elements in a window 10 for display of horological data (hours-minutes, date and seconds and LED display elements in a window 11 for display of the time (hours-minutes) and the date. The watch is enclosed in a case 12 which is provided with strap-securing ears 14 and 16.

In the preferred embodiment, the watch is a wristwatch. However, it should be clearly understood that the same construction, circuitry and display can be employed in a pocket watch.

Compact batteries (not shown) are included in the case 12 to supply power to the electronic circuitry. A face 18 is mounted on the front of the watch case. The face crystal can be a color filter to enhance LCD and LED displays. A mask 20 can be seen through the face crystal. The mask has the display windows 10 and 11.

The LCD display seen through window 10 includes four digits and a colon. The one position 22 on the left consists of a single segment for display of the digit 1 only. The remaining digits 24, 26 and 28 consist of seven segments, although the top and bottom segments of 26 are always on or off at the same time. As will be noted more fully hereinafter, the horological data from the electronic system is converted from binary-coded decimal (BCD) data to seven segment code to energize selected segments in forming decimal digit displays. The LCD display remains on continuously, displaying hours and minutes, except when a push button $B_2$ alone or push button $B_2$ and $B_1$ in combination, are depressed. When it is desired to display either the date or the seconds, the hours display is blanked out and the date or seconds is selected for display in the minutes position by depressing button $B_2$, or buttons $B_1$ and $B_2$ simultaneously, respectively.

The LED display in window 11 is very similar to the LCD display, except that the display elements consist of seven segment light emitting diode displays, one for the digit position 30 on the left, which uses only two segments, and one for each of digit positions 32, 34 and 36. The LED display is activated by means of manually operated push buttons $B_1$ and $B_2$ for the respective display of time and date. No other LED display is provided since it is wasteful of power to display seconds on the LED display. The display of seconds by the LCD elements in the present invention occurs by depressing both push buttons $B_1$ and $B_2$ simultaneously. For example, doctors and nurses require a display of seconds in taking a patient's pulse. But they would like to have one hand free. Consequently, as a further feature of the present invention, when the two buttons are released, the LCD elements will continue to display seconds until either of the push buttons $B_1$ and $B_2$ is momentarily depressed. That resets the LCD to display hours and minutes, the normal mode, without causing any display by the LED elements. If the time is thereafter to be displayed by the LED elements, the LED button $B_1$ must again be depressed. If the date is to be displayed, the Date button $B_2$ must be depressed. The date is then displayed on the LCD elements until the button is released. If the date is to be displayed on the LED elements, the button $B_2$ must be held depressed past a predetermined time (about 1.5 seconds). The date is then displayed by the LED elements as long as $B_2$ remains depressed.

The watch includes recessed push button $B_3$ which can be depressed by a pointed object for the purpose of setting the clock by slewing the hour, minute or date counters in the system. If only the Set button $B_3$ is depressed, only the hour counter is slewed. If $B_1$ is also depressed, only the minute counter is slewed and the second counter is reset to zero instantaneously when minutes slew is begun. If $B_2$ and $B_3$ are depressed together, only the date counter is slewed. And finally, if all three buttons are depressed all counters are reset. The control functions of the three push buttons are summarized in the following table.

| LED $B_1$ | Date $B_2$ | Set $B_3$ | LCD Response | LED Response |
|---|---|---|---|---|
| 0 | 0 | 0 | Hours - minutes | Off |
| 1 | 0 | 0 | Hours - minutes | Hr-min. |
| 0 | 1 | 0 | Date | Date |
| 1 | 1 | 0 | Seconds | Off |
| 0 | 0 | 0 | (From 110 state) seconds | Off |
| 0 | 0 | 1 | *Slew hours | Off |
| 1 | 0 | 1 | *Slew min., instantaneously zero sec. | Off |
| 0 | 1 | 1 | *Slew date | Off |
| 1 | 1 | 1 | *Master reset | Off |

*LCD response to $B_1$ and $B_2$ is not affected by $B_3$.

The physical structure of the substrates upon which the display devices are mounted and the relationship of the substrates to the circuit are disclosed in detail in the aforesaid application and in the application of I. B. Merles and R. F. Zurcher Ser. No. 343,319, filed Mar. 21, 1973, assigned to the assignee of the present application.

Figure 2:
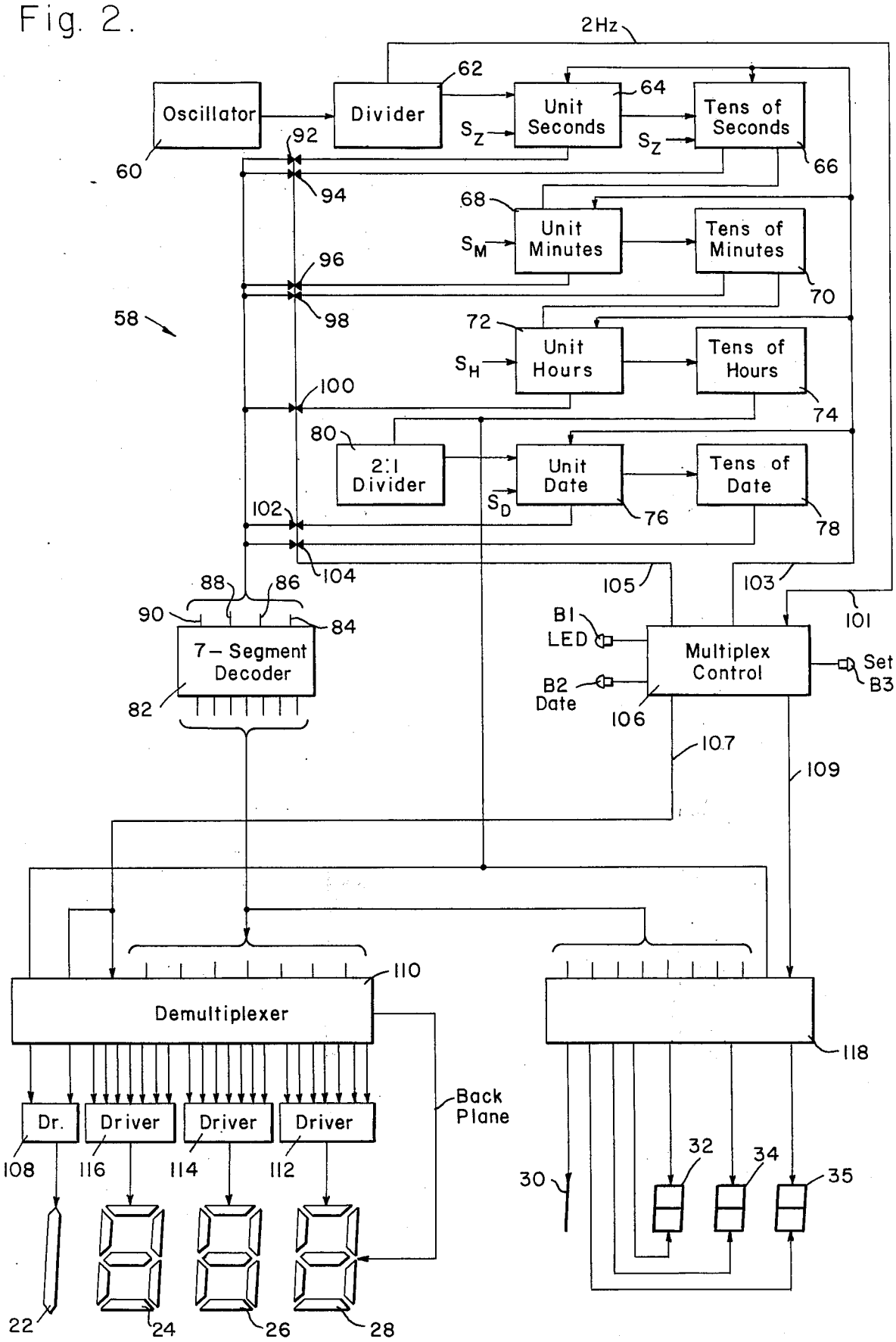
FIG. 2 is a block diagram of the electronic system in the digital watch of this invention.

Referring now to FIG. 2, the digital watch circuit consists of an electronic oscillator 60 which is crystal-controlled to oscillate at a predetermined and substantially constant frequency. It, as well as the other circuits, are powered by two compact batteries (not shown) mounted in the watch case. Several or all of the circuits can be and preferably are contained on the same integrated (CMOS) circuit chip to minimize assembly labor and chances of misassembly, minimize size, and provide a watch of maximum reliability.

The output from the crystal controlled oscillator 60 is driven into a standard CMOS divider 62 which produces output pulses of several frequencies including 1 Hz. The one Hertz pulse drives the unit seconds counter 64 (a standard CMOS decade counter) wich counts from 0 to 9. The unit second counter in turn drives the CMOS tens-of-seconds counter 66 which counts from 0 to 5 to satisfy the requirement of 60 seconds per minute. All successive counters are designed so that, at the end of each counter's normal count sequence, a pulse is sent to the next counter in cascade. All outputs taken from the counters are standard 1, 2, 4, 8 (4 bit) binary coded decimal (BCD). Similar to the unit seconds counter's operation, the tens-of-seconds counter 66 drives the unit minutes counter 68. The unit minutes counter 68 then drives the tens-of-minutes counter 70, which counts from 0 to 5. The tens-of-minutes counter 70 then drives the unit hours counter 72. Continuing the chain of counters, the unit hours counter 72 then drives the tens-of-hours counter 74. All of these counters are BCD counters, but those which do not count past 7, require only three flip-flops, and tens-of-hours requires only one flip-flop and is not decoded later.

The present embodiment of the invention contemplates a 12 hour watch. Therefore, the tens-of-hours counter 74 controls the tens-of-hours "number 1" display device 22, and does not need to count beyond that logic state. It is a special counter which is controlled by the unit-hours counter 72 to illuminate the tens-of-hours display devices 22 and 30 for the 10th, 11th, and 12th hours. Thereupon, it resets. Similarly, it is interconnected with the unit-hours counter 72 so that, when the tens-of-hours counter 74 resets at the end of the 12th hour, the unit-hours counter 72 does not reset to zero, but resets to 1. Thus, there is mutual intercontrol between counters 72 and 74.

Logic circuitry not shown decodes "12 o'clock" from the hours counters 72 and 74, which occurs twice a day. This output is connected through divider 80 of the input of unit-date counter 76. Therefore, the unit-date counter 76 advances only once per day. Unit-date counter 76 thus receives a pulse every day and emits a pulse every 10 days. Tens-of-date counter 78 need only reach 3, and thus does not require four flip-flops, but only two, to perform its tasks. Tens-of-date counter 78 is linked (by logic not shown) to unit-date counter 76 so that, when the total attemps to pass 31 days, counter 78 resets to zero and counter 76 resets to 1.

Seven-segment decoder 82 is a device which receives BCD signals from the counters and emits 7-segment coded signals which correspond to the seven segments of the liquid crystal and the LED display devices to be energized for display of any decimal digit. For convenience a single seven-segment decoder 82 is employed, and the inputs and outputs therefrom are multiplexed. Since it is desired to display different horological information, it is necessary to switch different counters into the input of the seven-segment decoder.

There are four inputs 84, 86, 88 and 90 to the seven-segment decoder, each carrying 1 bit of the binary coded decimal information from the counters. Transmission gate sets 92, 94, 96 and 98, respectively, connect counters 64, 66, 68 and 70 to the BCD buss containing lines 84, 86, 88 and 90. Similarly, transmission gate sets 100, 102 and 104 respectively connect counters 72, 76 and 78 to the BCD buss. The gates are all connected to multiplex control unit 106. The multiplex control unit 106 has outputs represented by lines 103, lines 105, lines 107 and lines 109. Lines 105 control the transmission gates selecting data to send to the decoder 82. Lines 107 control the demultiplexer 110, which is necessary because liquid crystal displays cannot be multiplexed. Lines 109 control the LED digit driver, ensuring that displayed digits appear in the proper position. Lines 103 control setting min., hr., and date, and zeroing seconds. Multiplex control has inputs 101 from the divider to provide setting timing, display timing, and multiplex sequencing. Under normal operating conditions, the multiplex control unit 106 operates in such a manner that lines 105 deliver synchronized signals to the transmission gates so that BCD states are delivered to the decoder 82. Multiplex control unit 106 sequentially delivers signals corresponding to unit-minutes to be displayed on the LCD display 28, tens-of-minutes on position 26, unit-hours on position 24.

The output of seven-segment decoder 82 represents the energization of the 7 segments of a display for display of the number whose BCD data is on lines 84, 86, 88 and 90. However, the output from the seven-segment decoder 82, which is going to the LCD display positions must be demultiplexed to drive the LCD display. The demultiplexer 110 has as its input the seven-segment lines and digit position information from multiplex control 106, via lines 107. The demultiplexer 110 has as its output a set of seven-segment lines for each of the devices 24, 26 and 28. Display drivers 112, 114 and 116 are connected in these lines between the demultiplexer and respectively the display devices 28, 26 and 24. Demultiplexer 110 is controlled by multiplex control unit 106 so that the seven-segment decoder information is properly distributed to the display-driver inputs, which in turn continuously energize selected segments.

When a gate display is desired, push button $B_2$ is depressed. This causes the multiplex control unit to scan the unit-date and tens-of-date counters 76 and 78, instead of the minutes and hours counters. In this case, the date stored in these counters is displayed. It is preferable to display the unit-days and tens-of-days on display positions 28 and 26 respectively, as in the preferred embodiment shown. Thus, the minutes and hours are not displayed while push button $B_2$ is depressed but the date recorded in the date counters is displayed. Unused positions of the display are blanked by circuitry not shown. Similarly, if display of the seconds is desired, depressing push button $B_1$ and $B_2$ simultaneously will activate the multiplex control unit so that the unit-seconds and tens-of-seconds information stored in counters 64 and 66 are scanned and are displayed in display positions 28 and 26. Furthermore, if additional counters were incorporated, by simple extrapolation from the disclosed counters, the month could be displayed with the date. As noted before, the push button $B_1$ is depressed for LED display of the time (hours and minutes). That starts a counter in the control unit 106 to time out the LED display for the predetermined time (about 1.5 seconds). For this time, or as long as the button is pushed, whichever is longer, the time is displayed on the LED positions. The multiple control 106 enables the digit drivers 120 (over lines 109) to display the time in the LED positions 30, 32, 34 and 36.

When the date button $B_2$ is depressed, the normal time display in LCD positions is replaced with the date data from counters 76 and 78 until it is released. At the same time the date is displayed in the LED positions, but only if the button $B_2$ is held depressed for more than the predetermined time of about 1.5 seconds. In that manner, the counter which times the LED display of time (hours and seconds) is also used as a delay timer to inhibit LED display of the date unless the operator holds the Date button $B_2$ depressed for a longer period. That prevents LED display of the date from being effective when $B_2$ is depressed under normal light conditions. In the dark, the operator will not be able to see the date on the LCD positions (because liquid crystal display elements require ambient light to be visible and do not emit light as light emitting diodes do). Consequently he will instinctively hold the button $B_2$ until he sees the date displayed in the LED positions.

When both the LED button $B_1$ and the Date button $B_2$ are depressed together, the multiplex control unit 106 sequentially routes the seconds data through transmission gate sets 92 and 94. At that time, a flip-flop in the multiplex control 106 is set to keep the transmission gate sets 92 and 94 turning on sequentially. This permits hands off display of seconds, as noted before. To restore normal LCD response to the push button state 000 as described in the table, either the button $B_1$ or the buttton $B_2$ is depressed momentarily to reset the flip-flop in the multiplex control. At the time that flip-flop is initially set, other possible display functions are locked out by the multiplex control 106. Resetting the flip-flop returns the watch to the normal LCD response, but LED response is inhibited until another push, or until after the timer has timed out.

When push buttons $B_1$ and $B_2$ are unactuated, the multiplex control unit 106 sequentially opens transmission gate sets 96, 98 and 100, via lines 105, allowing the information from unit minutes counter 68, tens-of-minutes counter 70, and unit hours counter 72, respectively, to be delivered to the 7-segment decoder 82, to the demultiplexer 110, and finally to their respective display drivers to be displayed on liquid crystal elements 28, 26 and 24, respectively.

It should be noted that the digit position 22 of the LCD display and the digit position 30 of the LED display will show only the digit 1 for the hours 10, 11 and 12, and nothing for the date (or seconds in the case of LCD display). Consequently, the tens-of-hours counter 74 is not routed through a controlled transmission gate and is instead connected directly to the LCD demultiplexer and the LED digit driver. The digit 1 is blocked by multiplex control 106 through lines 107 and 109 except in the hour-min display mode. A digit 0 is never displayed in the digit positions 22 and 30 for the hours 1 through 9. This is accomplished with zero blanking logic not shown.

When push buttons $B_1$ and $B_2$ are depressed, the control outputs 105 from the multiplex control unit 106 enable transmission gate sets 92 and 94 to sequentially connect unit seconds counter 64 and tens-of-seconds counter 66, respectively, to the 7-segment decoder 82. The LCD demultiplexer 110 distributes the units and tens data to display elements 28 and 26 respectively. Lines 107 also blank the first two digits.

When only push button $B_2$ is depressed, outputs 105 from the multiplex control unit 106 sequentially enable transmission gate sets 102 and 104 to transmit data from unit date counter 76 and tens-of-date counter 78.

The data from unit date counter 76 and tens-of-date counter 78 is respectively delivered through the decoder 82, the demultiplexer 110, and display driver 112 and 114 to display elements 28 and 26. Outputs 107 from multiplex control unit 106 determine which LCD display positions will receive information from the decoder 82, and which will be blanked out. Display element 28 receives the information from the unit date counter 76 and display element 26 receives the information from tens-of-date counter 78. Outputs 109 similarly determine which LED display positions receive the hour and the minute data, and which are blanked out.

The output from 7-segment decoder 82 is demultiplexed in order to drive the LCD positions 28, 26 and 24 with continous square waves. Display drivers 112, 114 and 116 continuously energize each segment of liquid crystal display elements 28, 26 and 24, respectively with square waves either in phase or out of phase with a back plane square wave. When a transmission gate is closed, thereby impeding information from a counter to its display element, the demultiplexer 110 will maintain the last information received from the counter.

As just pointed out above, when no push buttons are depressed, transmission gates 96, 98 and 100 are sequentially enabled to connected unit minutes counter 68, to tens-of-minutes counter 70 and to unit hours counter 72, respectively, to the 7-segment decoder 82 under control of lines 105. Consequently, when push-buttons $B_1$ is depressed, the control unit 106 merely responds by enabling the LED digit drivers 120, via control lines 109, but only when depressed longer than the predetermined time (about 1.5 seconds), or at least the predetermined time, whichever is longer, as noted before.

It should be noted that although these control lines 105, 107 and 109 out of the unit 106 are shown as single lines in the drawing, they actually consist of several control lines. These control lines 105, 107 and 109 are here shown as discrete single lines merely to facilitate understanding the logical operation of the present invention. However, from the foregoing it is clear that push buttons $B_1$ and $B_2$ control which counters are to be connected to the decoder, and as there are four units of time, namely hours, minutes, date and seconds, control lines 105 contain seven individual lines, two for time-division multiplexing seconds BCD data through transmission gate sets 92 and 94, three for time-division multiplexing of the hours and minutes digits through transmission gate sets 96, 98 and 100, and two for time-division multiplexing of the date BCD data through transmission gate sets 102 and 104. Each digit is transmitted as four BCD signals in parallel, all in response to the control of push buttons $B_1$ and $B_2$. In view of this, it will be appreciated by buttons $B_1$ and $B_2$ will continue uninterrupted. What is interrupted is the normal operation of the counters involved in the display.

Referring now to the functions controlled by the push button $B_3$, it should be noted, from the table of control functions set forth before, that when $B_1$ and $B_2$ are not depressed, the time (hours and minutes) is being displayed by the LCD elements. Consequently, when only the push button $B_3$ is depressed, the hours are being displayed and will be advanced. That is done by slewing the unit hours counter, i.e., by applying clock pulses at a rate of 1 Hz. The rapidly changing hours display will thus permit the hour of the time to be set while the operator views the changes being made on the LCD display. Push button $B_1$ is depressed with $B_3$ as a control for setting the minutes in the same way, i.e., by applying clock pulses at the 1 Hz rate to the unit minutes counter 68 while the operator views the changes being made on the LCD. Immediately upon releasing the control push button $B_3$ the slewing stops. The hours can thus first be set by depressing only $B_3$ and the minutes by then depressing $B_1$ also. Hours will not advance if minutes are being slew set. In addition to slewing the minutes counter, the seconds counters 64 and 66 are instantaneously reset to zero at the beginning of minutes slew, for accurate setting of the time as broadcast by the National Bureau of Standards (NBS). It is a simple matter to start slewing the minutes at the instant when the seconds are zero. When the minutes are correct, $B_1$ is released. The water will then be set at the NBS time to within 1 second. The LED display is inhibited during all slew setting. All the setting is done by the multiplex control unit 106 through the lines 103.

The date counters 76 and 78 reset to one after counter through 31 days. At the end of each month having fewer than 31 days, it is necessary to reset the date by slewing the unit date counter 76. That is done by depressing the buttons $B_2$ and $B_3$. Again the set button $B_3$ inhibits display of the date on the LED display, but not on the LCD. The operator can thus observe the normal LCD display of the date until the correct date is reached.

Figure 3:
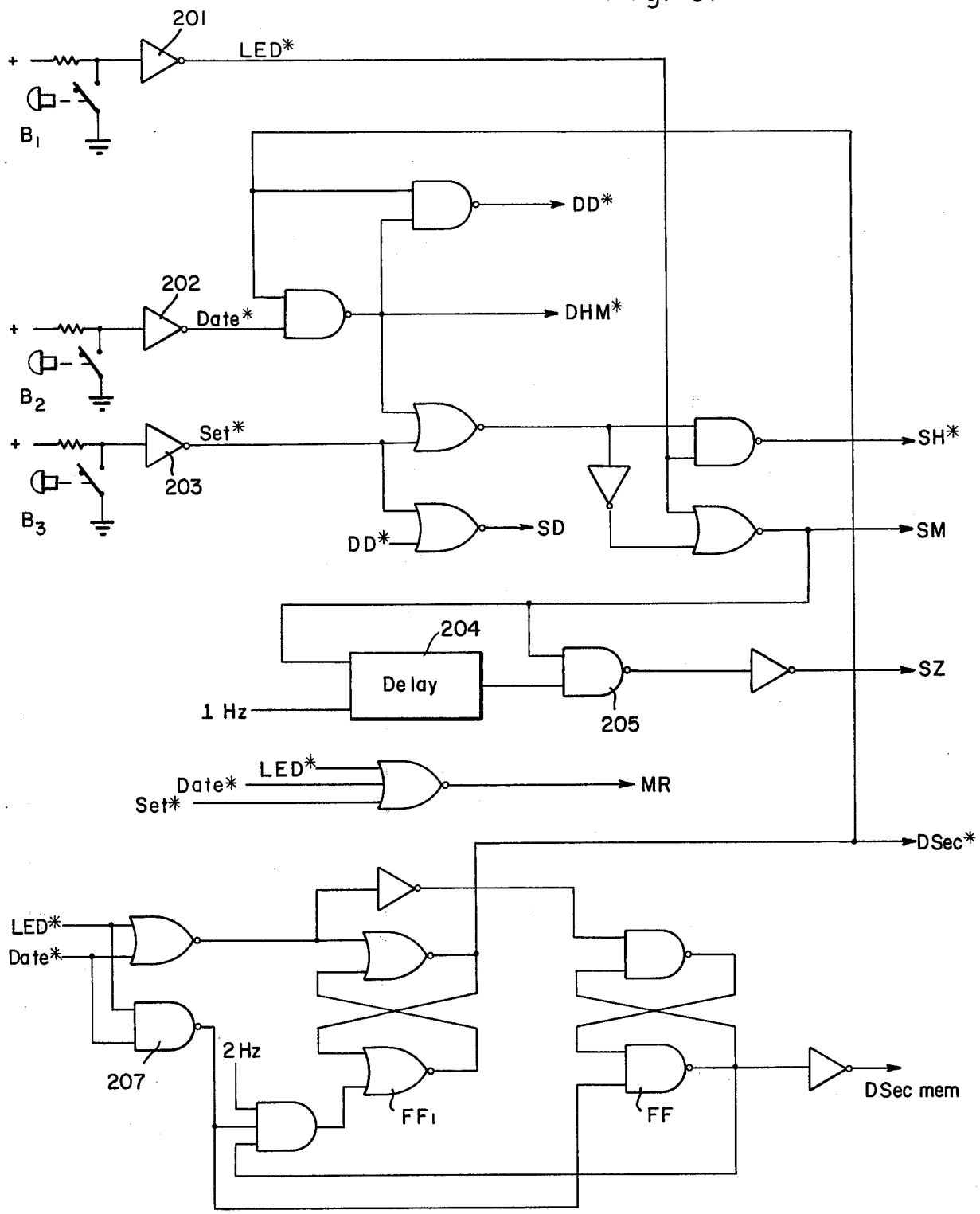
FIG. 3 is a logic diagram of the button decoding section in the multiplex control unit of FIG. 2 for all display and watch setting functions.

FIG. 3 shows a logic diagram for the decoding logic in the multiplex control unit 106 which responds to the push buttons $B_1$, $B_2$ and $B_3$ to provide control signals for the nine functions set forth before in a table. The decoding logic employs AND, NAND and NOR gates in the configuration shown to generate the control signals according to the following table.

| $B_1$ | $B_2$ | $B_3$ | CONTROL SIGNAL |
|---|---|---|---|
| 0 | 0 | 0 | DHM (display hrs-min) |
| 1 | 0 | 0 | DHM (display hrs-min) |
| 0 | 1 | 0 | DD (display date) |
| 1 | 1 | 0 | DSEC (display seconds) |
| 0 | 0 | 0 | DSEC (display seconds) "hands off" (from 110 state) |
| 0 | 0 | 1 | SH (slew hours) |
| 1 | 0 | 1 | SM (slew minutes), SZ instantaneously zero seconds |
| 0 | 1 | 1 | SD (slew date) |
| 1 | 1 | 1 | MR (master reset) |

In the foregoing table, a 1 means the button indicated at the head of the column is pushed, and in the logic diagram of FIG. 3 a 1 is represented by a positive voltage level (positive logic). The complement of a signal, indicated by an asterisk, is active when it is at a ground (negative) voltage level. The CMOS integrated circuit techniques employed to implement the invention often require complementary signals. For example, invertors 201, 202 and 203 are employed to produce the signals LED*, DATE* and SET* when the respective buttons $B_1$, $B_2$ and $B_3$ are pushed. Operating on those complementary signals, the decoder depicted in FIG. 3 functions in a straight forward manner for NAND-NOR logic. The "delay" 204 is employed in combination with an AND gate 205 to create a pulse for zeroing seconds. Some of the control signals generated are complements of the time signals, as indicated by the asterisks in FIG. 3, but that is generally only for convenience in implementing the circuits controlled, which is not important as other polarity signals could be used to implement the invention. What is important is only that the requisite control signals are generated as required.

Figure 4:
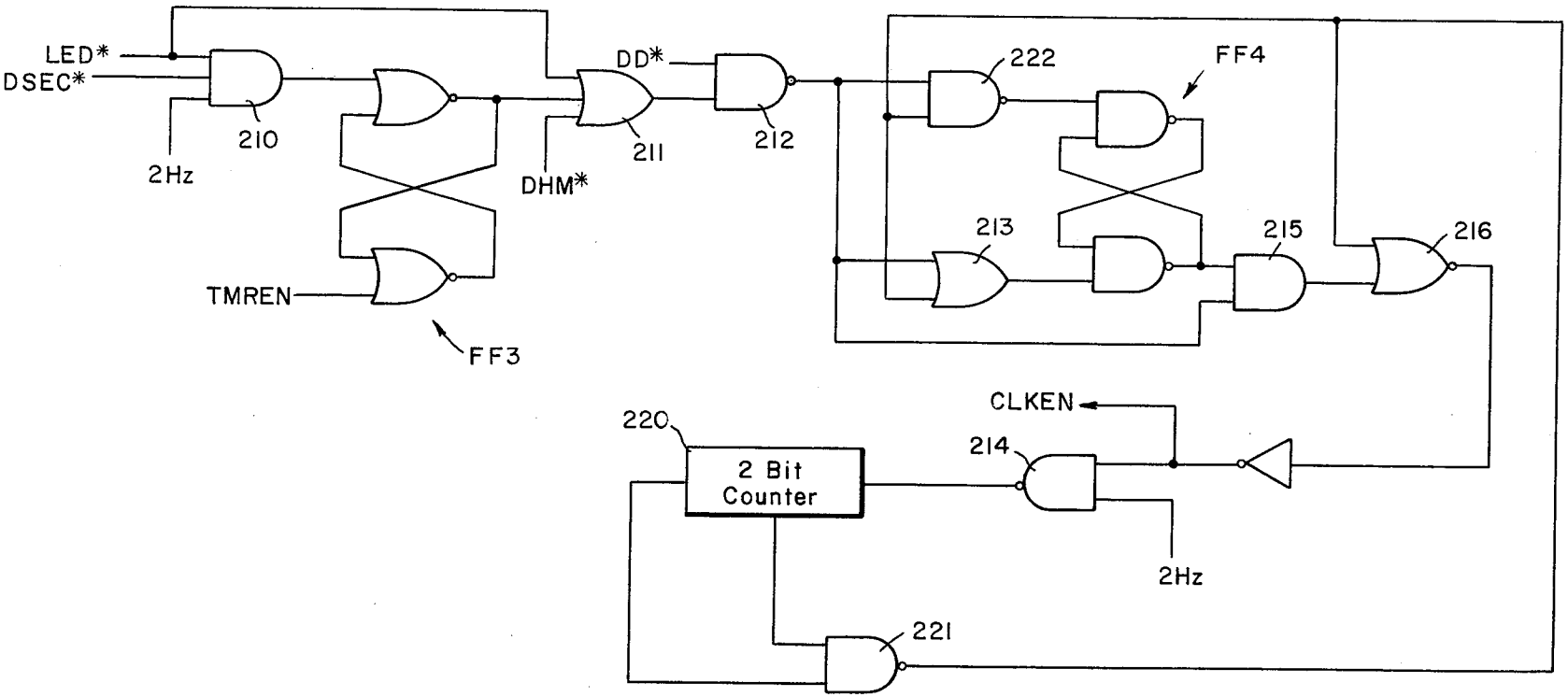
FIG. 4 is a logic diagram of a 1.5 seconds timer employed in the multiplex control unit of FIG. 2 for control of LED display functions.

The network for generating the control signal DSEC* employs two cross coupled NOR gates forming a flip-flop $FF_1$ and two cross coupled NAND gates forming a flip-flop $FF_2$ used to store the fact that both $B_1$ and $B_2$ have been depressed, as determined by NOR gate 206. As will be described more fully with reference to FIG. 4, the signal DSECMEM sets a flip-flop $FF_3$ to disable a timer and thereby prevent an LED display when pushing the LED button to get out of the seconds mode. If either $B_1$ and $B_2$ is depressed momentarily, as detected by NAND gate 207, to terminate seconds display, the signal DSECMEM is removed from flip-flop $FF_3$ (FIG. 4). After release of $B_1$, the timer is thus enabled to again display horological data on the LED display. In the meantime, while the flip-flop $FF_1$ is set, DSEC* causes the seconds to be continuously displayed by the LCD elements.

Referring now to FIG. 4, and recalling that the flip-flop $FF_3$ was set by DSECMEM signal in response to a display seconds instruction, NOR gate 211 is disabled by that condition of the flip-flop $FF_3$ until it is reset. This is to inhibit an LED display of anything when the LED button is pushed to get out of "display seconds" mode. However, once either button $B_1$ or button $B_2$ is depressed to generate an LED* or DATE* signal respectively, the flip-flop $FF_3$ (FIG. 3) is reset, and that in turn removes the set from flip-flop $FF_3$. Flip-flop $FF_3$ is reset after $B_1$ is released. Thus flip-flop $FF_1$ serves as a memory for DSEC* and flip-flop $FF_3$ serves as a lock-out for an LED response to $B_1$.

Once flip-flop $FF_3$ is reset, buttons $B_1$ or $B_2$ are responded to normally. The other LED display functions are to display hours and minutes (DHM* and LED* on gate 211) or to display the date (DD* on gate 212). Either function will set flip-flop $FF_4$ via an OR gate 213 if the button is held long enough to let the counter advance from the 11 state. Initially the counter is in the state 11. It counts four pulses to return to the state 11 which in combination with not pushing a button, will reset the flip flop $FF_4$ via OR gate 213. Because of NOR gate 216 the counter is locked up in the state 11, thus timing a period of 1.5 seconds. During this timing period a signal CLKEN is generated.

The signal CLKEN is used for two purposes. If the button $B_1$ was depressed to display the time (hours and minutes) in the LED positions, the signal CKLEN is used to time the display, thus lighting the LED display 1.5 seconds even if the button $B_1$ was released before that much time expired. If held depressed longer, LED* will override the timer to permit time (hours and minutes) to be displayed as long as held depressed. If the button $B_2$ is depressed to display the date, the date data is immediately routed to the LCD positions for display as long as the button is held depressed. Unless the operator is in the dark, he will observe the date within that period and release the button. The signal CLKEN inhibits the LED devices from displaying the date during that period. If the operator is in the dark, he will hold the button until the delay of 1.5 seconds has elapsed. Then CLKEN will go to 0 and the date will be displayed in the LED positions for as long as the button is held depressed.

The remaining button control functions, setting and master reset, do not involve flip-flops $FF_1$, $FF_2$, $FF_3$, or $FF_4$ or the counter 220. Instead, the decoded signals SH, SM, SD and SZ are applied directly to the hours, minutes, date and seconds counters, respectively for the operations indicated of slewing the hours (SH), slewing minutes (SM), slewing date (SD), or for zeroing the seconds counter (SZ). That is accomplished by applying the signals directly to the respective units counters while the appropriate buttons are held depressed to gate 1 Hz pulses directly into the counters for slewing, or in the case of the seconds counter, resetting the units and tens-of-seconds counters to zero.

What is claimed is:

1. In a digital electronic watch having two distinct digital displays for display of horological data, one display being a liquid crystal display (LCD) for low power display of hours and minutes and selected other data, and the other a light emitting diode (LED) display for use in low ambient light levels, said watch comprising a plurality of counters in cascade for counting clock pulses from a stable oscillator to keep time at least as to seconds, minutes, and hours, the combination comprising:

a number of $n$ of push buttons, $n$-1 push buttons for selecting the counters from which horological data is to be displayed and for controlling on which display the data will appear, and one for use in setting of said counters in order to set the horological data in the watch;

means for decoding the state of said push buttons to obtain distinct display and setting functions;

control means for carrying out said functions as called for;

said control means continuously displays hours and minutes in said low power display while no buttons are depressed;

said decoding means detect the condition of a predetermined first one of said buttons being depressed by itself, and said control means responds to the detected condition to display hours and minutes in said light emitting diode display as well as in the LCD display;

timing means responsive to said decoding means for displaying hours and minutes in said light emitting positions for at least a predetermined period of time;

said decoding means detects the condition of a predetermined second one of said buttons being depressed by itself and said control means responds to the detected condition to display other horological data on said low power display while depressed, and means for utilizing a timing means to determine the time of this alternate horological data display and means responsive to said timing means for causing the alternate horological data display, after passage of a predetermined time interval, to also be displayed on said light emitting diode display while said predetermined second one of said buttons continues to be depressed.

2. The combination of claim 1, wherein said alternate horological data is date data.

3. The combination of claim 1, wherein said decoding means detects the condition of only predetermined first and second ones of said buttons being depressed to cause the seconds to be displayed on said low power display.

4. The combination of claim 1, wherein said decoding means detects the condition of a third one of said buttons depressed, and including means for causing counters associated with the horological data being selected for display by the condition of other buttons to receive clock pulses directly for the purpose of setting part or all of the horological data which is being displayed.

5. The combination of claim 3, including bistable means and means for setting said bistable means to one state in response to detection of said first and second ones of said buttons depressed to retain display of seconds after said first and second ones of said buttons are released, and means for detecting when either of said first and second ones of said buttons is depressed to reset said bistable means and terminate display of seconds.

6. The combination of claim 4, wherein said decoding means detects the condition of all buttons depressed and causes a reset of all counters associated with horological data.

* * * * *

UNITED STATES PATENT AND TRADEMARK OFFICE

CERTIFICATE OF CORRECTION

PATENT NO. : 4,026,101

DATED : May 31, 1977

INVENTOR(S) : NORMAN E. MOYER

It is certified that error appears in the above-identified patent and that said Letters Patent are hereby corrected as shown below:

Column 1, line 37, "push buttons" instead of "push button".

Column 1, line 68, please insert quotation marks around (")hands off(")

Column 4, line 7, "which" instead of "wich"

Column 5, line 40, "date" instead of "gate".

Column 7, line 27, "connect" instead of "connected".

Column 7, line 56, after the word appreciated insert "that when the set button $B_3$ is depressed, the display controlled".

Column 8, line 18, "watch" instead of "water".

Column 8, line 23, "counting" instead of "counter".

Signed and Sealed this

*Twenty-seventh* Day of *September 197*

[SEAL]

*Attest:*

RUTH C. MASON
*Attesting Officer*

LUTRELLE F. PARKER
*Acting Commissioner of Patents and Trademark*